US009404051B2

(12) United States Patent
Heerze

(10) Patent No.: US 9,404,051 B2
(45) **Date of Patent: *Aug. 2, 2016**

(54) PETROLEUM BIOPROCESSING TO PREVENT REFINERY CORROSION

(75) Inventor: Louis D. Heerze, Edmonton (CA)

(73) Assignee: Her Majesty The Queen In Right Of Canada As Represented By The Minister Of Natural Resources, Ontario (CA)

( * ) Notice: Subject to any disclaimer, the term of this patent is extended or adjusted under 35 U.S.C. 154(b) by 515 days.

This patent is subject to a terminal disclaimer.

(21) Appl. No.: 13/264,212

(22) PCT Filed: Apr. 14, 2009

(86) PCT No.: PCT/CA2009/000487

§ 371 (c)(1),
(2), (4) Date: Oct. 13, 2011

(87) PCT Pub. No.: WO2010/118498

PCT Pub. Date: Oct. 21, 2010

(65) Prior Publication Data

US 2012/0028341 A1 Feb. 2, 2012

(51) Int. Cl.
*C10G 75/00* (2006.01)
*C10G 31/00* (2006.01)

(52) U.S. Cl.
CPC ..... *C10G 31/00* (2013.01); *C10G 75/00* (2013.01); *C10G 2300/1033* (2013.01); *C10G 2300/203* (2013.01); *C10G 2300/4075* (2013.01); *C10G 2300/44* (2013.01); *C10G 2300/802* (2013.01)

(58) Field of Classification Search
None
See application file for complete search history.

(56) References Cited

U.S. PATENT DOCUMENTS

| | | | | |
|---|---|---|---|---|
| 5,683,626 | A | 11/1997 | Sartori et al. | |
| 6,251,305 | B1 * | 6/2001 | Sartori et al. | 252/387 |
| 6,258,258 | B1 * | 7/2001 | Sartori et al. | 208/263 |
| 2008/0051599 | A1 * | 2/2008 | Adami et al. | 560/129 |

FOREIGN PATENT DOCUMENTS

| | | | |
|---|---|---|---|
| WO | 9507359 | A1 | 3/1995 |
| WO | WO 9507359 | A1 * | 3/1995 |

OTHER PUBLICATIONS

Patent Cooperation Treaty, PCT International Search Report and Written Opinion of the International Searching Authority for PCT/CA2009/000487 dated Dec. 18, 2009, 10 pages.
European Patent Office, Extended European Search Report for EP Application 09843182.8 dated Aug. 25, 2014, 6 pages.

* cited by examiner

*Primary Examiner* — Lisa J Hobbs
(74) *Attorney, Agent, or Firm* — Stephen F. Swinton, Jr.; Hoffman Warnick LLC

(57) ABSTRACT

The present invention relates to the bioupgrading of crude oil is directed to a process for decreasing the acidity of an acidic crude oil, comprising contacting an acidic crude oil with a mixture nitrogen containing compounds selected from the group comprising ammonia, ammonia hydroxide, amines and the salts thereof, and in the presence of lipase enzyme, under conditions of suitable temperature and pressure sufficient to form the corresponding amide. The resulting naphthenic acid derived amides can then be processed normally in a refinery using such processes as cracking or hydrotreating and converted to hydrocarbon, ammonia and carbon dioxide without causing damage to the refinery infrastructure. This enzyme process is done at reduced temperatures (40-60° C.) and pressures requiring less energy.

8 Claims, 13 Drawing Sheets

PETROLEUM BIOPROCESSING TO PREVENT REFINERY CORROSION

FIELD OF THE INVENTION

The present invention relates to a process for bioupgrading crude oil. More specifically, the present invention discloses the use of lipase enzyme to convert naphthenic acid compounds, in combination with ammonia hydroxide or other amines, into amides that do not possess any corrosive properties. The resulting naphthenic acid derived amides can then be processed normally in a refinery using such processes as cracking or hydrotreating and converted to hydrocarbon, ammonia and carbon dioxide without causing damage to the refinery infrastructure.

BACKGROUND OF THE INVENTION

The quality of crude oil throughout the world is reduced by acidic components found in the oil. During refining, at temperatures between 220 and 400° C., these species can become corrosive. Acidic species such as naphthenic acids that have boiling points in this temperature range will condense on metal surfaces leading to damage in the refinery infrastructure, potential safety issues, and costly repairs. As a result, oils with high acid content, whether from conventional (crude oil) or oil sands (bitumen) sources, are more difficult to market and their value is significantly discounted.

Conventional methods to remove corrosive species from crude oil involve costly and energy-intensive chemical and thermal processes. For example, the current technologies developed to remove organic acids from crude oil involve either thermal decomposition at 400° C. (Blum et al. in U.S. Pat. No. 5,820,750), adsorbing onto inert materials (Varadaraj in U.S. Pat. No. 6,454,936), treating with surfactants (Gorbaty et al. in Canadian Patent 2,226,750) or converting the organic acids into various derivatives that are easier to remove (Brons in U.S. Pat. No. 5,871,637, Sartori et al. in Canadian Patents 2,343,769 and 2,345,271, and Varadaraj et al. in U.S. Pat. No. 6,096,196).

Efforts to minimize organic acid corrosion have included a number of approaches for neutralizing and removing the acids from the oil. For example, there are numerous approaches in the literature on the reduction of the organic acid species in crude oil. They include thermal decomposition of organic acids using high temperatures in the presence (U.S. Pat. Nos. 5,914,030, 5,928,502) or absence (U.S. Pat. No. 5,820,750) of a metal catalyst and treatment of corrosive acids with group IA and IIA metal oxides, hydroxides and hydrates to form metal salts of naphthenic acids which are then thermally decomposed at elevated temperatures (U.S. Pat. Nos. 5,985,137, 5,891,325, 5,871,637, 6,022,494, 6,190,541, 6,679,987). Other methods include chemical formation of esters of the organic acids in the presence of alcohol and a base (U.S. Pat. Nos. 5,948,238, 6,251,305, 6,767,452, and Canadian Patent 2,343,769), reducing acidity by the formation of various salts of organic acids using base (U.S. Pat. Nos. 5,643,439, 5,683,626, 5,961,821, 6,030,523), removal of naphthenic acids using detergents or surfactants (U.S. Pat. Nos. 6,054,042, 6,454,936), absorbing organic acids onto polymeric amines (U.S. Pat. Nos. 6,121,411, 6,281,328) and by adding corrosion inhibitors to crude oil to prevent naphthenic acid induced metal corrosion (U.S. Pat. No. 5,552,085).

U.S. Pat. No. 6,258,258 and Canadian Patent 2,345,271 describe the formation of naphthenic acid amides by treating crude oil with excess ammonia at elevated temperatures (above 180° C.) and elevated pressures (100-400 kPa).

While these processes have achieved varying degrees of success, most of these methods are costly and energy-intensive and their effectiveness somewhat limited. As a result, there is a need to develop alternative approaches to eliminate the corrosive species in petroleum and for treating acidic crudes.

Recently it has been reported that lipase B (Mickiyo in European Patent 0287634), from the fungi *Candida Antarctica*, produced by industrial enzyme producer Novozymes, demonstrated catalytic activity in the hydrolysis of fatty acids and converts them into fatty acid esters in the presence of alcohol (Anderson et al. in *Biocat. Biotrans.* 1998, 16, 181-204). The enzyme also has the ability to convert fatty acids, carboxylic acids and triglycerides into amides by the addition of amines or ammonia (DeZoete et al. in PCT Patent Application PCT/EP1994/003038 with publication number WO 95/07359; DeZoete et al. in *Ann. NY Acad. Sci.* 1996, 799, 346-350; Egraz in U.S. Pat. No. 5,973,203; Hacking et al. in *Biotech. Bioeng.* 2002, 68, 84-91; Ignacio et al. in *Chem. Soc. Rev.* 2004, 33, 201-9; Irimescu et al. in *Tet. Lett.* 2004, 45, 523-525; Litjens et al. in PCT WO 00/58490; Madeira Lau et al. in *Org. Lett.* 2000, 2, 4189-4191; and Tuccio et al. in *Tet. Lett.* 1991, 32, 2763-2764).

However, the art is substantially bereft of methods for upgrading the quality of crude oil comprising naphthenic acids by the use of enzymes or biocatalysts. U.S. Pat. Nos. 7,101,410, 6,461,859 and 5,358,870 describe the use of biocatalysts, such as bacteria, fungi, yeast, and algae, hemoprotein, and a cell-free enzyme preparation from *Rhodococcus* sp. ATCC 53969, respectively, to improve the quality of oil specifically target organic sulphur containing molecule by reducing the sulphur content as well as lowering their viscosity. U.S. Pat. No. 5,858,766 describes the use of microorganisms (a bacteria strain) in a bioupgrading capacity to selectively remove organic nitrogen and sulphur in oil as well as remove metals.

There remains the need for bioprocesses, as an attractive alternative to current upgrading methods, that use enzymes to improve the quality of crude oil and bitumen by removing acidic species.

SUMMARY OF THE INVENTION

The present invention is directed to bioupgrading, i.e., using enzymes to improve the quality of crude oil and bitumen. The advantages of bioupgrading technologies lie in that they operate under much milder conditions, for example, at lower temperatures and pressures, compared to those required by conventional technologies. Consequently, much less energy will be required. As a result, the environmental impacts would be reduced. Furthermore, since biocatalysts and enzymes are specific in their conversions, only the undesirable components—in this case, corrosive species—are converted into non-corrosive ones without affecting the rest of the crude oil. The result is an improvement in the overall quality of the oil and refinery corrosion prevention.

The present invention identifies a bioupgrading use for a lipase enzyme, more specifically but not limited to lipase B (Novozyme™ 435) originally isolated from the fungi *Candida antarctica*, and now a recombinant enzyme expressed in *Aspergillus oryzae*. This lipase enzyme has the capability to convert organic acids including naphthenic acid model compounds, in combination with ammonia hydroxide or other amines, into chemical species (amides) that do not possess any corrosive properties.

The amide products generated from enzyme reaction were confirmed by gas chromatography-mass spectrometry (GC-MS) analysis. The resulting naphthenic acid derived amides can then be processed normally in a refinery using such processes as cracking or hydrotreating and converted to hydrocarbon, ammonia and carbon dioxide without causing damage to the refinery infrastructure.

One of the advantages of this lipase B enzyme is that the enzyme is thermostable and can function at temperatures of 40-60° C. The enzyme can carry out bioconversions in organic solvents such as toluene or heptane and possesses broad substrate specificity. As such, lipase B, and/or similar suitable enzymes, can be used to reduce the corrosive properties of crude oil and bitumen by converting organic acids including naphthenic acids in crude oil into a non-corrosive species such as naphthenic acid amides. This process is done at reduced temperatures (40-60° C.) and pressures that require less energy. The resulting naphthenic acid derived amides can then be processed normally in a refinery using such processes as cracking or hydrotreating and converted to hydrocarbon, ammonia and carbon dioxide without causing damage to the refinery infrastructure.

In one aspect of the present invention, it discloses a process for decreasing the acidity of an acidic crude oil, comprising:

a. contacting an acidic crude oil with at least one nitrogen containing compound, and b. incubating the mixture obtained from step (a) in the presence of lipase enzyme;

under conditions of suitable temperature and pressure sufficient to form the corresponding amides.

BRIEF DESCRIPTION OF THE DRAWINGS

The invention will now be described by way of reference to the drawings, in which.

DETAILED DESCRIPTION OF THE INVENTION

Figure 1:
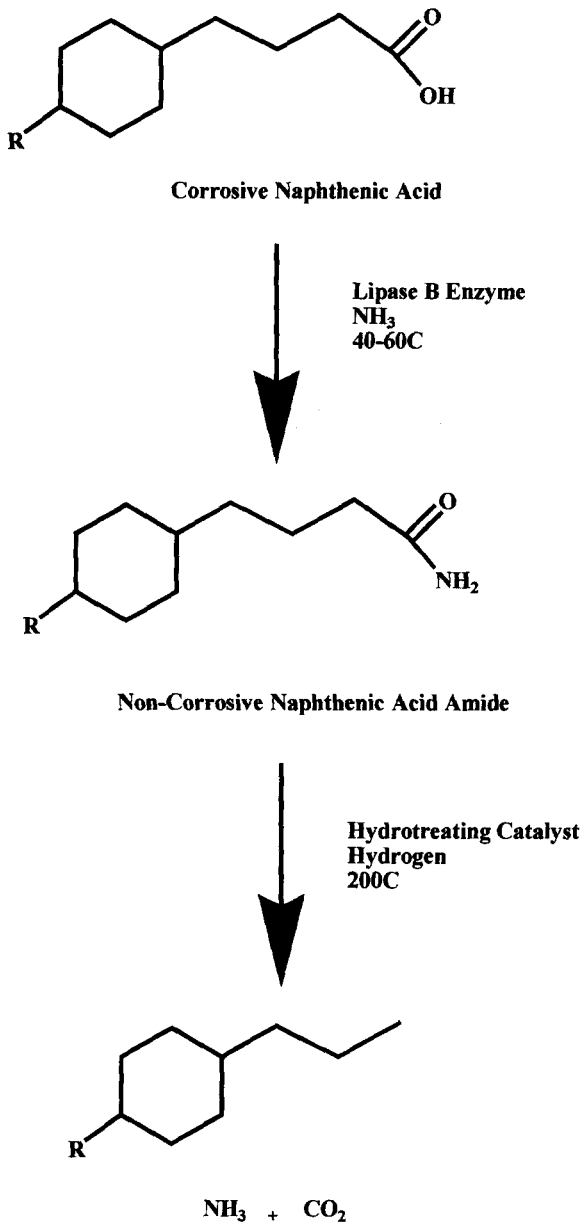
FIG. 1 illustrates the bioprocess to reduce refinery corrosion using lipase B.

Crude oils can contain organic acids that are mainly comprised of naphthenic acids that contribute to corrosion of refinery equipment at elevated temperature.

The present invention discloses that when organic acids, such as naphthenic acids, found in crude oil or bitumen are treated with enzymes, in particular lipase enzyme, in combination with ammonia hydroxide or other amines, they can be converted into naphthenic acids derived amides that do not possess corrosive properties. The process is accomplished by dissolving the naphthenic acid containing crude oil or bitumen in diluent (organic solvent). To the naphthenic acid solution were added ammonium hydroxide and/or other amines, such as ammonium carbamate or dodecylamine, and lipase enzyme resin. The mixture was then incubated at 40° C.-60° C. in a reactor with mixing. The resulting naphthenic acid derived amides found in the diluted crude oil or bitumen can then be processed normally in a refinery using such processes as cracking or hydrotreating and converted to hydrocarbon, ammonia and carbon dioxide without causing damage to the refinery infrastructure.

In a preferred embodiment of the invention, a lipase enzyme that is capable of synthesizing amides from carboxylic acids is used. For example, the lipase B enzyme from *Candida antarctica* is a thermostable enzyme that can complete this biochemical conversion at temperatures of 40-60° C.

Enzyme optimization studies using model naphthenic acid compounds and lipase B were performed to maximize the conversion of the acid substrates. Experiments were conducted by increasing the concentrations of the amine acceptor substrate (ammonium carbamate, hexylamine and dodecylamine) to maximize the conversion. The applicant has found that the optimal ratio of the amine acceptor substrate was between 1 to 1.1 and 1 to 1.4.

The lipase B enzyme was further tested at 60° C. to determine if enhanced product conversion could be obtained at a temperature at which crude oil is held prior to being sent to an upgrader or refinery for processing. The results show that a dramatic improvement of conversion at 60° C. compared to the conversion at 40° C.

The present invention may be demonstrated with reference to the following non-limiting examples.

General Conditions

Isolation of Naphthenic Acids from Crude Oil

The naphthenic acids from crude oil samples were obtained by absorbing the acids onto ion exchange resin. One or ten gram samples of the oils were taken and dissolved in either 4 mL or 40 mL of toluene. Each sample was done in duplicate and selected samples were repeated several times. To the diluted oil samples was added freshly prepared QAE Sephadex™ A-25 acid ion exchange resin to a concentration of 200 mg of resin/gram of crude oil. The resin was first prepared by washing the resin with 20 mL 1M $Na_2CO_3$/

$NaHCO_3$ followed by deionized water (3×5 mL) until the pH was approximately equal to 7, and finally with 5 mL of methanol. After adding the ion exchange resin to the diluted crude oil sample, it was gently stirred for 18 h.

The crude oil/resin mixture was then poured into a fritted glass filter and washed with three times with toluene (5-7 mL) and then 2:1 toluene/methanol (3×5 mL) to remove the unbound material. The naphthenic acid component was removed from the resin by adding 5 mL 1M formic acid and 10 mL 1:1 toluene/methanol. The resin and acid solution was stirred and allowed to equilibrate for 1-2 h prior to elution. The above process was repeated one more time using 3 mL 1M formic acid and 10 mL 1:1 toluene/methanol. The resin is mixed and allowed let stand for 1 h. It is then filtered by vacuum and washed until clear with 2:1 toluene/methanol as before. The solvent was then removed from the combined formic acid extracts under vacuum to yield the naphthenic acid extract. The extracts were then weighed and characterized by $^1H$ and $^{13}C$ NMR, infrared (IR) spectroscopy and high temperature simulated distillation boiling point (BP) analysis as well as elemental (CHNOS) analysis.

NMR Analysis of Naphthenic Acid Samples

The samples for $^1H$ NMR spectroscopy were prepared by mixing approximately 20 mg of the sample with 700 μL of deuterochloroform ($CDCl_3$). The NMR spectroscopic analyses were performed at room temperature (20±1° C.) on a Varian Inova™ 600 MHz NMR spectrometer, operating at 599.7 MHz for proton.

The proton spectra were collected with an acquisition time of 3.0 s, a sweep width of 20,000 Hz, a pulse flip angle of 30.6° (3.3 μs), and a 1 s recycle delay. These pulse recycle conditions permitted the collection of quantitative spectra for all protonated molecular species in the samples. The spectra, resulting used 0.3-Hz line broadening to improve the signal-to-noise ratio, were referenced to the residual chloroform resonance at 7.24 ppm.

Fourier Transform Infrared Spectroscopy

Fourier Transform Infrared (FTIR) samples were prepared by dissolving 50 mg quantities of acid-toluene or acid-white oil samples in 600 μL methylene chloride. Spectra were collected using a Thermo-Nicolet™ FTIR spectrometer and a 0.1 mm KBr fixed cell. A total of 128 transients were collected.

Gas Chromatography Mass Spectrometry

Samples were analyzed on a Hewlett Packard™ 6890 gas chromatograph with a 5973 series mass selective detector and a 30-m HP Rb-5MS column. The initial GC temperature program used for analysis was 45° C. for 5 min followed by an increase of 8° C/min to 340° C. with a final hold time of 5 minutes.

Experiments Using Lipase B-acrylic Acid (Novozyme™ 435)

1. Trial Incubations of Lipase B-acrylic Acid, Phenylbutyric Acid and Amine Acceptor Substrates Fifteen mg (91.4 μmol) of phenylbutyric acid was combined with 100 mg of *C. antarctica* lipase B-acrylic resin and amine substrates, ammonium hydroxide (6 μL, 108 μmol, dodecylamine (18.5 mg, 100 μmol) or cyclopentylamine (6 μL, 8.5 mg, 100.6 μmol) in 0.7 mL of toluene. The reaction was allowed to proceed with end-over-end mixing at room temperature for 4 h. After incubation, the immobilized enzyme was allowed to settle to the bottom of the vial, and the reaction mixture was carefully removed by pipette and then analyzed by GC-MS.

2. Trial Incubations of Lipase B-acrylic Acid, Ammonium Hydroxide and Carboxylic Acid Donor Substrates Fifteen mg of 4-phenylbutyric acid (91.4 μmol), 4-cyclohexylbutyric acid (88.1 μmol), trans-styrylacetic acid (92.5 μmol or indan-2-carboxylic acid (92.5 μmol) were combined with 20 mg of lipase B-acrylic resin and amine substrate, ammonium hydroxide (10 μL, 180 μmol) in 0.7 mL of toluene or heptane. The reaction was allowed to proceed with end-over-end mixing at room temperature for 18 h. After incubation, the immobilized enzyme was allowed to settle to the bottom of the vial, and the reaction mixtures were carefully removed by pipette and then analyzed by GC-MS.

3. Time Dependent Incubation of 4-cyclohexylbutyric Acid and Ammonium Hydroxide with Lipase B-acrylic Acid Fifty-one mg (299.6 μmol) of 4-cyclohexylbutyric acid was combined with 100 mg of lipase B-acrylic resin (specific activity 10,000 U/g) and amine substrate, ammonium hydroxide (6 μL, 8.5 mg, 100.6 μmol) in 1 mL of toluene. The reaction was allowed to proceed with end-over-end mixing at 40° C. for 1, 2, 4, 8 and 24 h. After incubation, the immobilized enzyme was allowed to settle to the bottom of the vial, and the reaction mixtures were carefully removed by pipette and then analyzed by GC-MS.

4. Concentration Dependent Incubation of 4-cyclohexylbutyric Acid or 4-phenylbutyric Acid and Ammonium Hydroxide with Various Amounts of Lipase B-acrylic Acid Fifty mg of either 4-cyclohexylbutyric acid (293.7 μmol) or 4-phenylbutyric acid (304.9 μmol) was combined with the amine substrate, ammonium hydroxide (6 μL, 8.5 mg, 100.6 μmol) in 1 mL of toluene. Various amounts (10, 50 or 100 mg) of lipase B-acrylic resin was added to the incubation mixtures and the reaction incubated with end-over-end mixing at 40° C. for 18 h. After incubation, the immobilized enzyme was allowed to settle to the bottom of the vial, and the reaction mixtures were carefully removed by pipette and then analyzed by GC-MS.

5. Trial Incubation of Athabasca and Asia 3 Naphthenic Acids with Lipase B and Amine Substrate The naphthenic acids isolated from Athabasca bitumen (50 mg) was dissolved in 1 mL of toluene. To the naphthenic acid solution was added ammonium hydroxide (6 μL, 8.5 mg, 100.6 μmol), ammonium carbamate (7.8 mg, 100 μmol) or dodecylamine (18.5 mg, 100 μmol) and 200 mg of lipase B-acrylic acid resin. After addition of the resin, the sample was then incubated overnight (approximately 18 hours) at 40° C. with end-over-end mixing. Each sample was done in duplicate.

Freshly prepared QAE Sephadex™ A-25 acid ion exchange resin (at a concentration of 200 mg of resin/gram) was added to the lipase-reacted samples. The ion exchange resin was first prepared by washing the resin with 20 mL 1M $Na_2CO_3/NaHCO_3$ followed by deionized water (3×5 mL) until the pH was approximately equal to 7, and finally with 5 mL of methanol. After adding the ion exchange resin to the diluted crude oil sample, it was gently stirred for 18 h.

The enzyme reaction mixture was then poured into a fritted glass filter and washed with three times with toluene (5-7 mL) and then 2:1 toluene/methanol (3×5 mL) to remove the unbound material. The material that was unbound to the resin was the lipase converted naphthenic acids. The naphthenic acid component was removed from the resin by adding 5 mL 1M formic acid and 10 mL 1:1 toluene/methanol. The resin and acid solution was stirred and allowed to equilibrate for 1-2 h prior to elution. The above process was repeated one more time using 3 mL 1M formic acid and 10 mL 1:1 toluene/methanol. The resin is mixed and allowed let stand for 1 h. It is then filtered by vacuum and washed until clear with 2:1 toluene/methanol as before. The solvent was then removed from the samples under vacuum to yield the naphthenic acid extract and the enzyme converted product. The samples were then weighed and the samples generated from the reaction with dodecylamine, characterized by $^1$H NMR. $D_2O$ exchange experiments were done on the same samples by adding a drop of $D_2O$ to the NMR tube and re-recording the spectrum.

Another experiment was done using the Asia 3 crude oil naphthenic acid sample was done as described above. Approximately 100 mg of Asia 3 naphthenic acids were dissolved in 4 mL of toluene. Separately, 37.2 mg dodecylamine was added to another 4 mL of toluene. One milliliter aliquots of the acid and dodecylamine were added to reaction vials, two of which contained approximately 200 mg of the lipase B-acrylic resin. The two other control vials did not receive any enzyme resin. An additional 1 mL of toluene was added to each of the reaction vials to thoroughly mix the substrates and the enzyme resin, and then incubated overnight (approximately 18 hours) at 40° C. with end-over-end mixing.

After reaction, the naphthenic acids were removed using ion exchange resin. The unbound material which represents the lipase generated products. The samples were then weighed and characterized by $^1$HNMR. $D_2O$ exchange experiments were done on the same samples by adding a drop of $D_2O$ to the NMR tube and re-recording the spectrum.

Lipase B Optimization Experiments

1. Concentration Dependent Incubation of 4-phenylbutyric Acid and Ammonium Carbamate or Dodecylamine with Various Amounts of Lipase B-acrylic Acid Fifty mg (304.9 μmol) of 4-phenylbutyric acid was combined with the amine substrate, ammonium carbamate (amounts ranging from 64 to 384 μmol) or dodecylamine (amounts ranging from 108 to 755 μmol) in 3 mL of toluene. One hundred mg of lipase B-acrylic resin was added to the incubation mixtures and the reaction incubated with end-over-end mixing at 40° C. for 18 h. All samples were run in duplicate. After incubation, the immobilized enzyme was allowed to settle to the bottom of the vial, and 200 μL of the reaction mixtures were carefully removed by pipette and then analyzed by GC-MS.

2. Incubations of Lipase B-acrylic Acid, Ammonium Carbamate, Hexylamine or Dodecylamine and Carboxylic Acid Donor Substrates Using Optimized Conditions Fifty mg of 4-phenylbutyric acid (304.9 μmol), 4-cyclohexylbutyric acid (293.7 μmol), trans-styrylacetic acid (308.3 μmol) or indan-2-carboxylic acid (308.3 μmol) were combined with 100 mg of lipase B-acrylic resin and amine substrates, ammonium carbamate (30 mg, 384 μmol), dodecylamine (80 mg, 432 μmol) or hexylamine (50 μL, 38 mg, 491 μmol) in 3 mL of toluene. The reaction was allowed to proceed with end-over-end mixing at 40° C. for 18 h. All samples were run in duplicate. After incubation, the immobilized enzyme was allowed to settle to the bottom of the vial, and 200 μL of the reaction mixtures were carefully removed by pipette and then analyzed by GC-MS.

3. Effect of Temperature on Product Formation on the Incubation of 4-phenylbutyric Acid and Hexylamine with Lipase B-acrylic Acid Fifty mg (304.9 μmol) of 4-phenylbutyric acid was combined with 100 mg of lipase B-acrylic resin and amine substrate, ammonium hydroxide (50 μL, 38 mg, 491 μmol) in 1 mL of toluene. The reaction was allowed to proceed with end-over-end mixing at either 40 or 60° C. for 0, 1, 3, 6 and 24 h. All samples were run in duplicate. After incubation, the immobilized enzyme was allowed to settle to the bottom of the vial, and 200 μL of the reaction mixtures were carefully removed by pipette and then analyzed by GC-MS.

Bioreactor Studies

1. Bioreactor Design for Use with Lipase B

A 2-mL coarse filtered fitted glass funnel was placed in a 25-mL glass vial with a Teflon lined silicone septum. 1.2 mm ID Teflon tubing was run from the bottom of the glass vial through the septum and a peristaltic pump and back through the septum into the fritted glass funnel. The fitted glass funnel was charged with 100 mg the lipase B-acrylic resin. The reaction components including the amine and carboxylic acid donor substrate or the naphthenic acid samples were dissolved (suspended in 10-mL of toluene and the liquid reaction mixture was placed in the glass vial that was fitted with a small stirring bar to ensure the reaction mixture was homogeneous throughout incubation. The reaction mixture was then circulated through the peristaltic pump and drip fed into the fitted glass funnel containing the lipase enzyme. The entire apparatus was incubated at a temperature of either 40 or 60° C. with the exception of the peristaltic pump and a minimal length of Teflon tubing.

2. Lipase B Stability Experiments

Using the bioreactor apparatus described above, the fitted glass funnel was charged with 100 mg of lipase B-acrylic acid resin. Fifty milligrams of 4-phenylbutyric acid and hexylamine (50-μL, 38 mg, 491 μmol) was dissolved in 10-mL of toluene in the glass vial. The assembled bioreactor was incubated at 40° C. for 24 h. After incubation, the fitted glass funnel was allowed to drain and the reaction mixture was removed. A fresh reaction mixture containing 50 mg of 4-phenylbutyric acid and 50-μL of hexylamine dissolved in toluene was placed in the glass vial, and the incubation restarted without changing the lipase B-acrylic acid resin in the fitted glass funnel, and allowed to proceed for 24 h. This was repeated for 2 additional consecutive incubations, or 4 incubations in total. From each reaction mixtures, a 200 μL sample was removed by pipette and then analysed by GC-MS.

Results

1. Use of the Lipase B Enzyme in a Bioprocess to Reduce the Corrosive Properties of Oil This lipase B enzyme could be used to reduce the corrosive properties of crude oil and bitumen by converting the naphthenic acids in crude oil into a non-corrosive species (naphthenic acid amides) as shown in FIG. 1. The generated amides would then treated by conventional hydrotreating processes resulting in an improved product that is no longer corrosive.

To determine whether the lipase B enzyme could function in a bioupgrading process, the immobilized enzyme (onto acrylic acid) was tested for the ability to bio-convert the model naphthenic acid compounds into amide products in combination with ammonium hydroxide in toluene.

Figure 2:
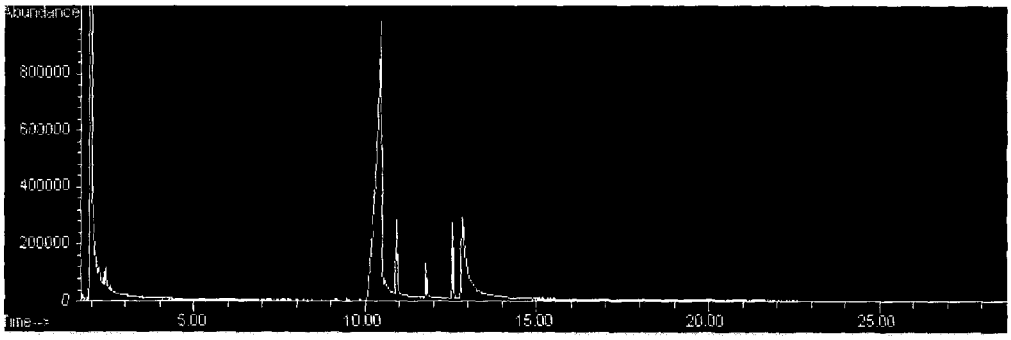
FIG. 2 is a GC elution profile for the incubation of the lipase B enzyme with 4-phenylbutyric acid and ammonium hydroxide.
Figure 3:
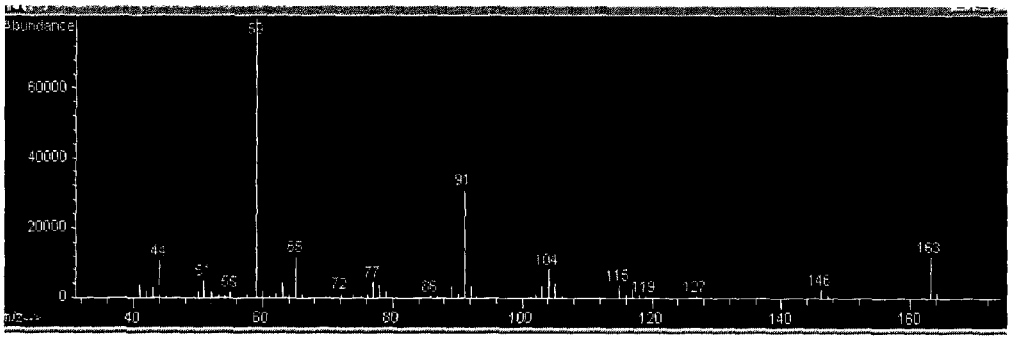
FIG. 3 is a mass spectrum of the major product generated from the lipase B catalyzed reaction of 4-phenylbutyric acid with ammonium hydroxide as shown in FIG. 2.

The results in FIGS. 2 and 3 demonstrate that the model naphthenic acid compounds can be converted into the desired amides as identified by gas chromatography-mass spectrometry (GC-MS) analysis. The results also indicate that the reaction proceeded cleanly with no side products being generated during the reaction. Similar assays were also performed using heptane as the solvent for the enzyme reaction with the same results.

Figure 4:
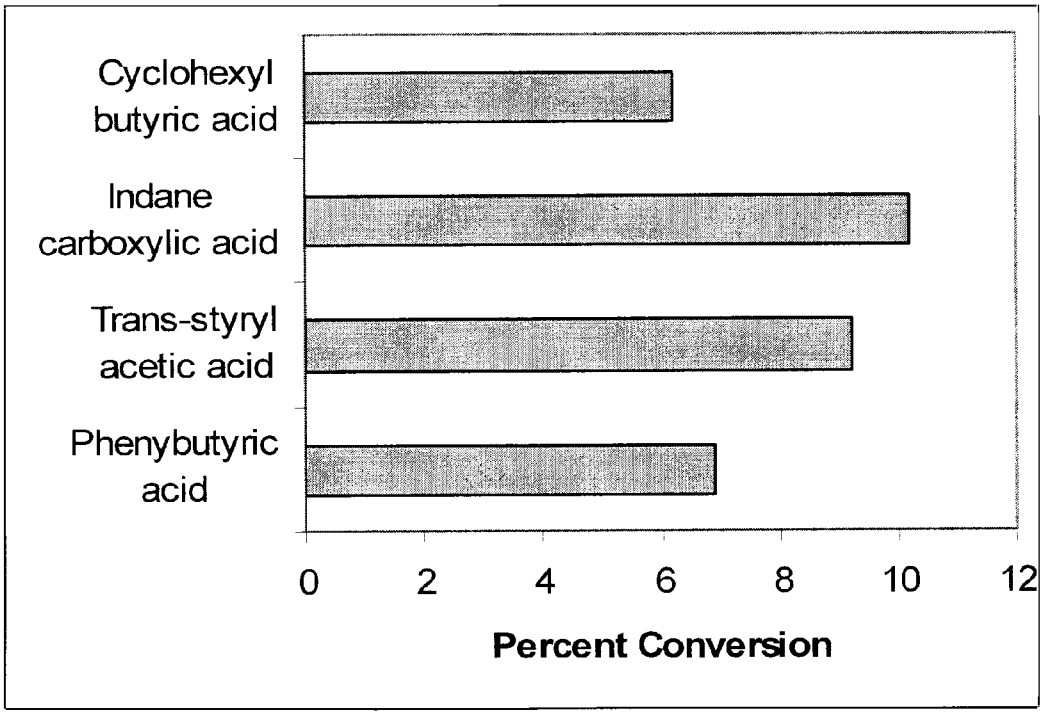
FIG. 4 illustrates donor specificity of lipase B using model naphthenic acid model compounds and ammonium hydroxide.
Figure 5:
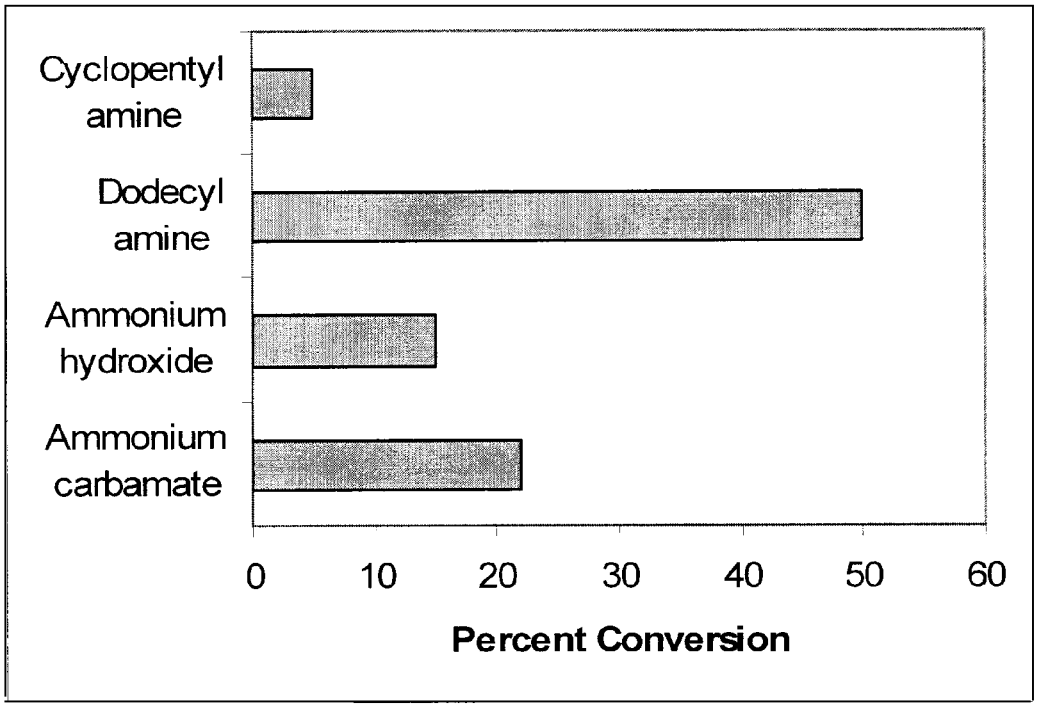
FIG. 5 illustrates acceptor specificity of lipase B using various amine acceptor substrates and 4-phenylbutyric acid.

The results in FIG. 4 also demonstrate that the lipase B enzyme can convert the model naphthenic acid acyl donor substrates into product to the same extent confirming the broad substrate specificity for the enzyme. A complimentary set of experiments were done to assess the capability of the lipase B enzyme to transfer an acyl group from phenylbutyric acid to a panel of amine acceptor substrates including ammonium carbamate, ammomiun hydroxide, cyclopentylamine and dodecylamine. All four amines were substrates for the lipase B enzyme as shown in FIG. 5 with a slight preference for the long chain alkyl amine, dodecylamine.

Figure 6:
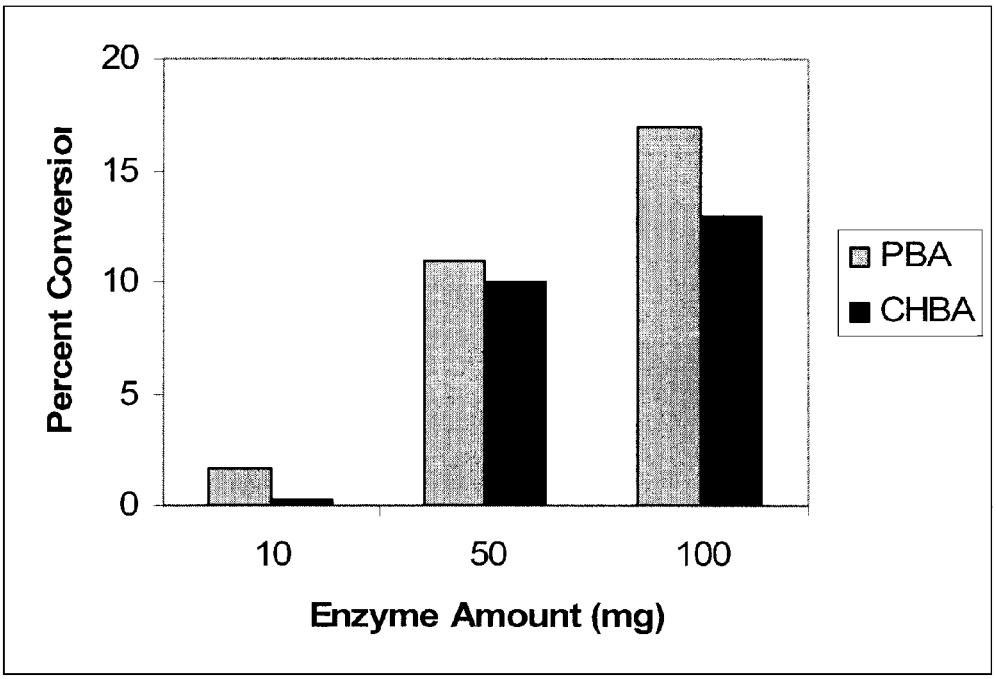
FIG. 6 illustrates the effect of the amount of lipase B on product formation for the reaction between either cyclohexylbutyric acid or 4-phenylbutyric acid and ammonium hydroxide.

In FIG. 6, the enzyme reaction was shown to proceed in a concentration dependent fashion when increased amounts of the immobilized lipase B enzyme were added to the reaction mixture containing either cyclohexyl- or phenylbutyric acid and ammonium hydroxide in toluene.

Figure 7:
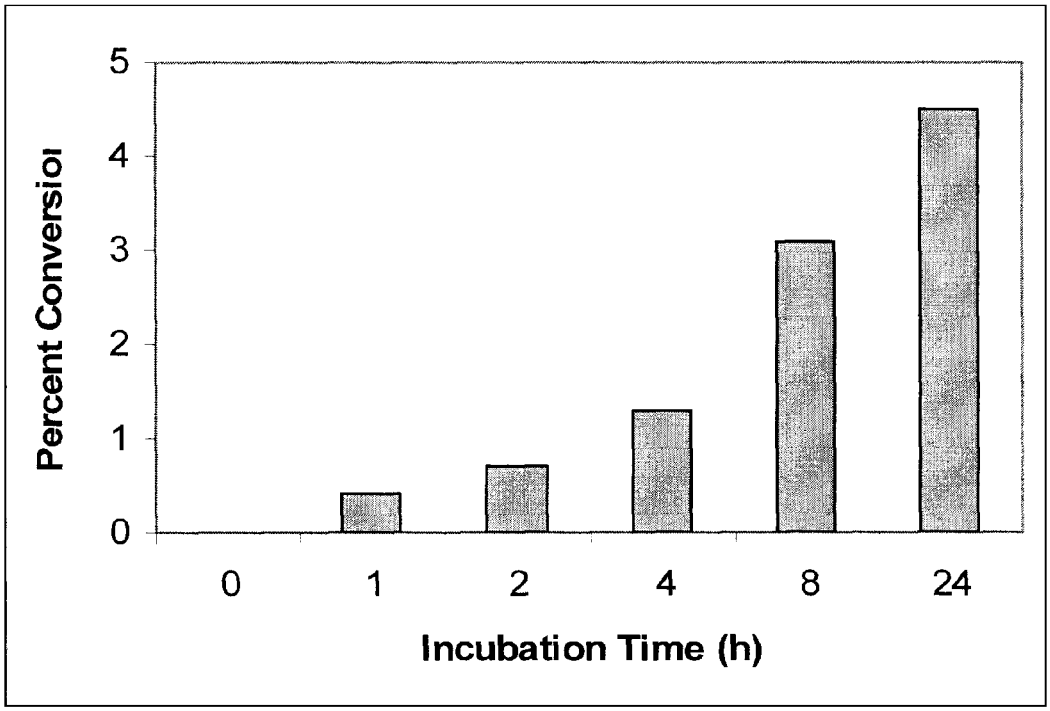
FIG. 7 illustrates the effect of incubation time on product formation for the reaction between cyclohexylbutyric acid and ammonium hydroxide.

In FIG. 7, the amount of product formed also increased in a time dependent manner in incubations with cyclohexylbutyric acid and ammonium hydroxide at 40° C.

Figure 8:
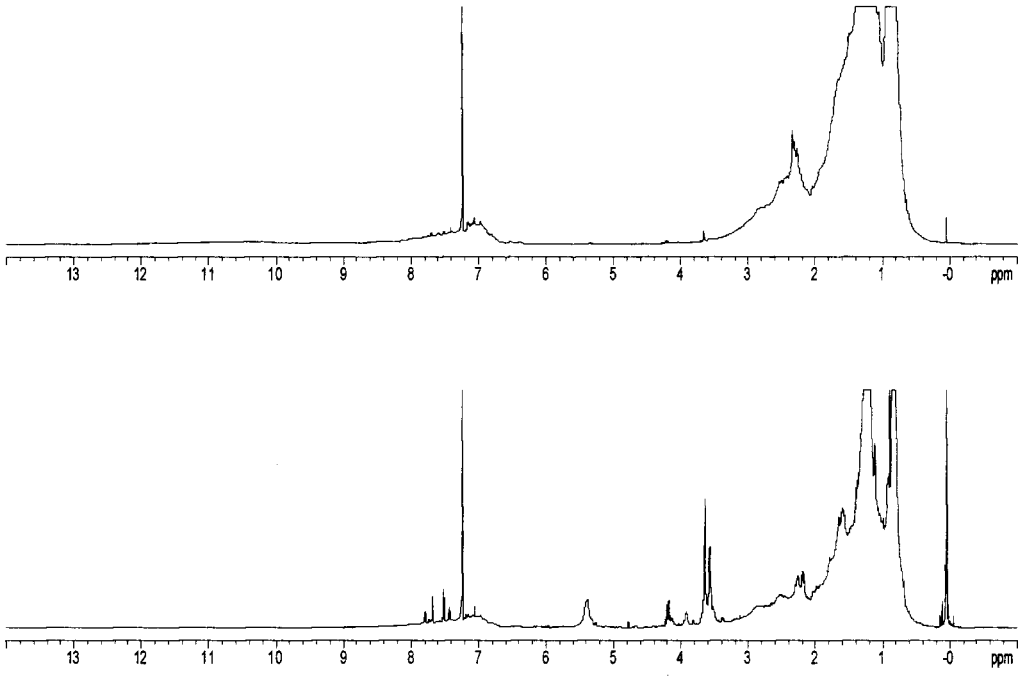
FIG. 8 is the $^1$H NMR spectra of the Athabasca naphthenic acids (upper) and the product generated from the reaction of Athabasca naphthenic acids with dodecylamine using lipase B (lower)

The enzyme results with the model naphthenic acid compounds are good predictors for the lipase B converting actual naphthenic acids found in crude oil. A series of experiments were done using the naphthenic acids isolated from Athabasca and Asia 3 crude oil samples. The Athabasca naphthenic acid isolate were dissolved in toluene and incubated with lipase B using ammonium hydroxide, ammonium carbamate and/or dodecylamine as the substrate. After the incubation, the resulting naphthenic acid amide could be readily separated from the unreacted naphthenic acid starting material by adsorbing the acid onto ion exchange resin. When using the Athabasca naphthenic acids as the donor substrate, 10, 15 and 13% of the starting material was converted into the product amide when using ammonium hydroxide, dodecylamine and ammonium carbamate as the donor amine substrate. A preliminary characterization of the product generated from the reaction of the Athabasca naphthenic acids with dodecylamine was done using $^{1}$H NMR. The results in FIG. 8 show a significant change in the amide product (bottom spectra) when compared to the naphthenic acid starting material (top spectra). The broad signal centred around 10.8 ppm, which is characteristic of carboxylic acids, is completely absent in the product spectra. This signal is replaced in the anticipated amide product with a new set of signals at 5.4 ppm. The characteristic chemical shifts for amide protons are between 4 and 9 ppm.

A complimentary set of experiments was done using the naphthenic acids isolated from Asia 3 crude oil, dodecylamine and lipase B. After reaction with lipase, the product was isolated from the naphthenic acid starting material as before, weighed and then subjected to $^{1}$H NMR analysis. The results indicated approximately a 50% conversion of Asia 3 naphthenic acids into product. The NMR spectra in FIG. 9 again show a difference of the enzyme product (lower spectra) when compared with the starting material.

Figure 9:
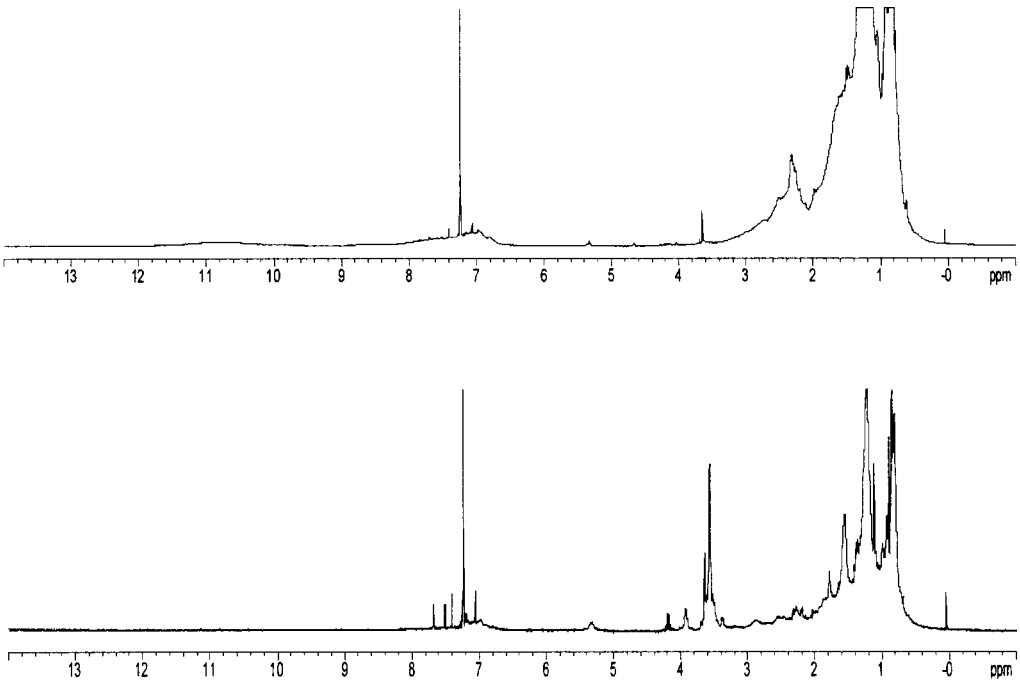
FIG. 9 is the $^1$H NMR spectra of the Asia 3 naphthenic acids (upper) and the product generated from the reaction of Asia 3 naphthenic acids with dodecylamine using lipase B (lower)

The combined results of the naphthenic acids isolated from Athabasca and Asia 3 crude oil suggest that the lipase B enzyme can convert naphthenic acids into naphthenic acid amides. The spectra in FIGS. 8 and 9 show the presence of additional peaks in the regions of 4 to 9. These peaks are suggestive of materials that originate from acrylic acid polymer support that is used to immobilize the lipase B enzyme.

Enzyme optimization studies were performed to maximize to conversion of the acid substrate into product. These experiments were done by increasing the concentrations of the amine acceptor substrate (ammonium carbamate and dodecylamine) to maximize the conversion of the donor substrate, phenylbutyric acid.

Figure 10:
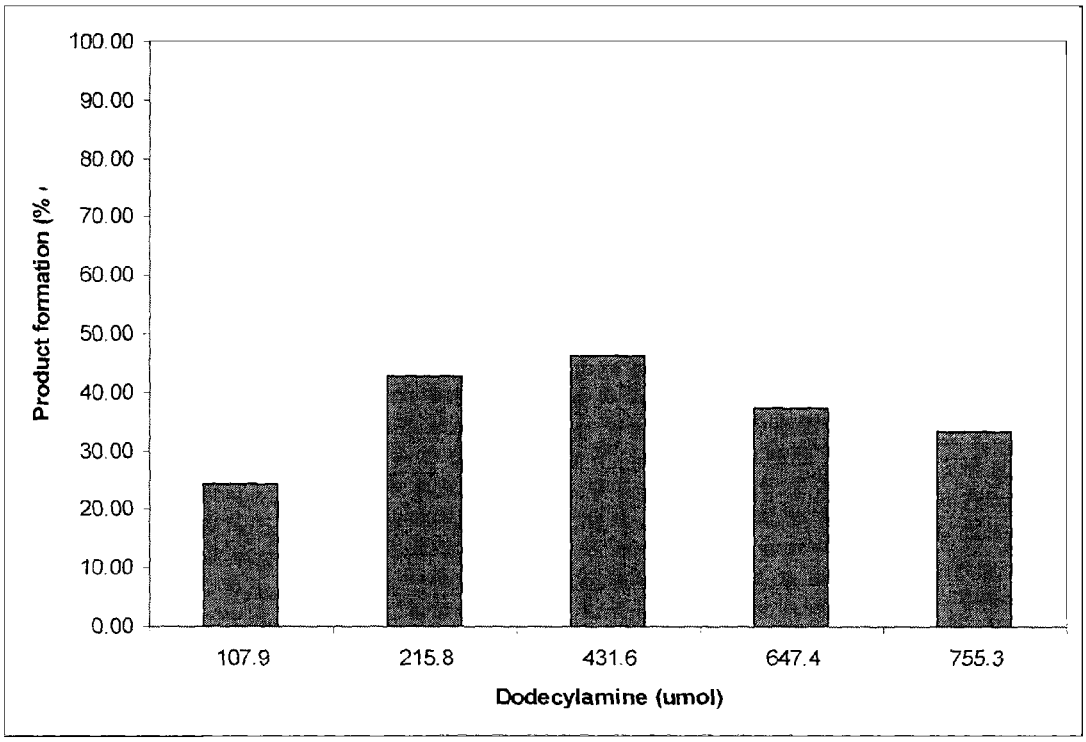
FIG. 10 illustrates the effect of the amount of dodecylamine on product formation for the reaction with 4-phenylbutyric acid.
Figure 11:
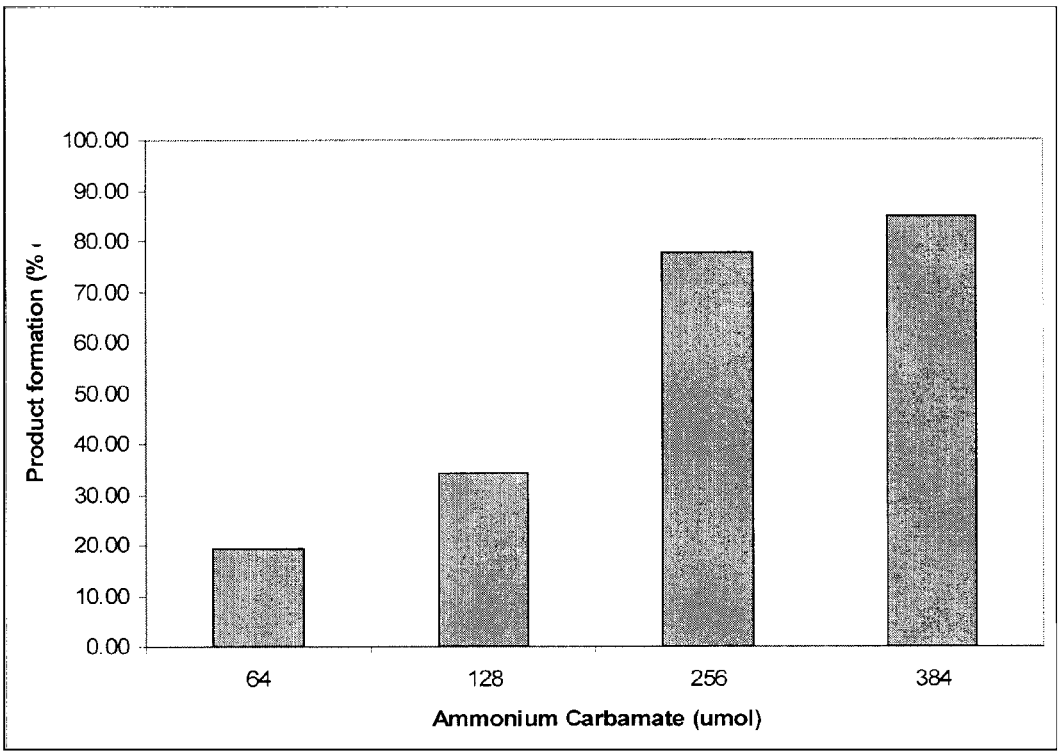
FIG. 11 illustrates the effect of the amount of ammonium carbamate on product formation for the reaction with 4-phenylbutyric acid.

The results in FIGS. 10 and 11 demonstrate that the optimal ratio of the acceptor substrate dodecylamine and ammonium carbamate was 1 to 1.4 and 1 to 1.3 respectively. Using these ratios of substrates, more than half of the starting material was converted into product. These optimized conditions were then used to determine if enhanced conversion of a panel of acid donor substrates into product amines could be achieved.

Figure 12:
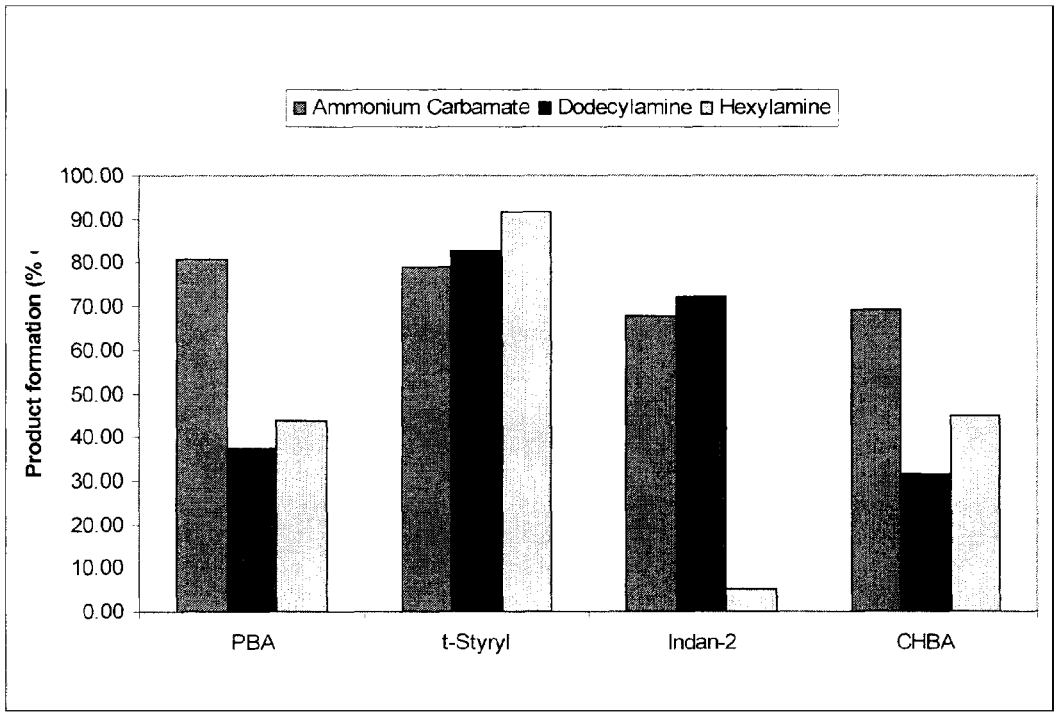
FIG. 12 illustrates donor specificity of lipase B using various amine acceptor substrates using optimized conditions.

FIG. 12 shows the results of the experiments where an additional amine substrate, hexylamine, was also added to the studies. As expected, this amine was a substrate for the lipase enzyme. The results show a significant increase in amide formation. Generally a 5 to 11-fold increase in substrate conversion was achieved when compared to the preliminary results shown in FIG. 4.

Figure 13:
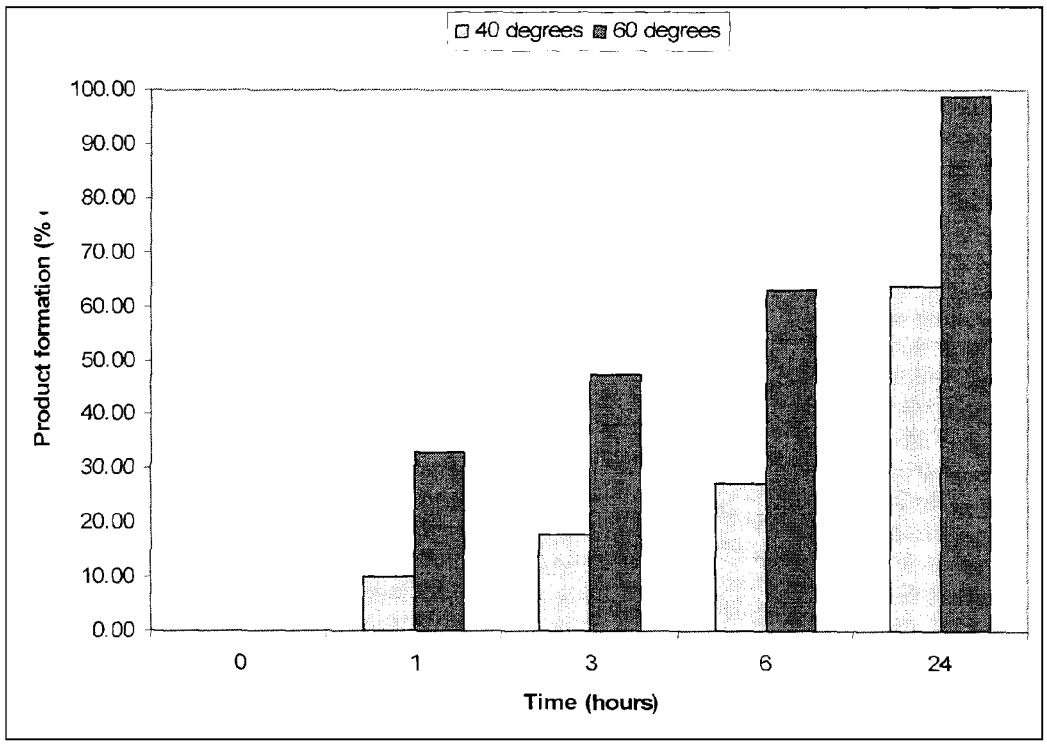
FIG. 13 illustrates the effect of incubation time and temperature on product formation for the reaction between phenylbutyric acid and hexylamine.

As mentioned previously, *C. antarctica* lipase B has the ability to function at a wide variety of elevated temperatures. The lipase enzyme was tested at 60° C. to determine if enhanced product conversion could be obtained at a temperature at which crude oil is held prior to being sent to an upgrader or refinery for processing. The results in FIG. 13 show that a dramatic improvement was observed in the conversion of hexylamine and phenylbutyric acid into product at 60° C. when compared to the conversion at 40° C. After 6 h of reaction, 63% of the substrates were converted into product at 60° C. as compared to only 27% at 40° C. After 24 h of incubation, 99% of the substrates were converted to product at 60° C. compared to 64% at 40° C.

At this point, it was determined that characterization had proceeded sufficiently far to warrant an experimental setup which would more closely mimic a possible final application, and also provide better mixing of the reaction solution with the inert Lipase B-acrylic resin beads. The new miniature bioreactor apparatus would need to be rapidly assembled and dismantled, and easily scalable from small volumes (5-10 mL) to much larger volumes in the future, without changing the basic design. To this end, an apparatus was constructed to mimic a batch feed fixed bed reactor system, appropriately scaled to the volumes which were currently in use. A 2 mL fritted glass Buchner funnel with a coarse filter was used to support the Lipase and placed in a 25 mL glass vial with a Teflon and silicone septum. 1.2 mm ID Teflon tubing was used in conjunction with a peristaltic pump to drip the reaction solution from the glass vial to the Lipase in the fritted glass funnel, thus ensuring adequate exposure of the reaction mixture to the immobilized Lipase B-acrylic acid resin.

Figure 14:
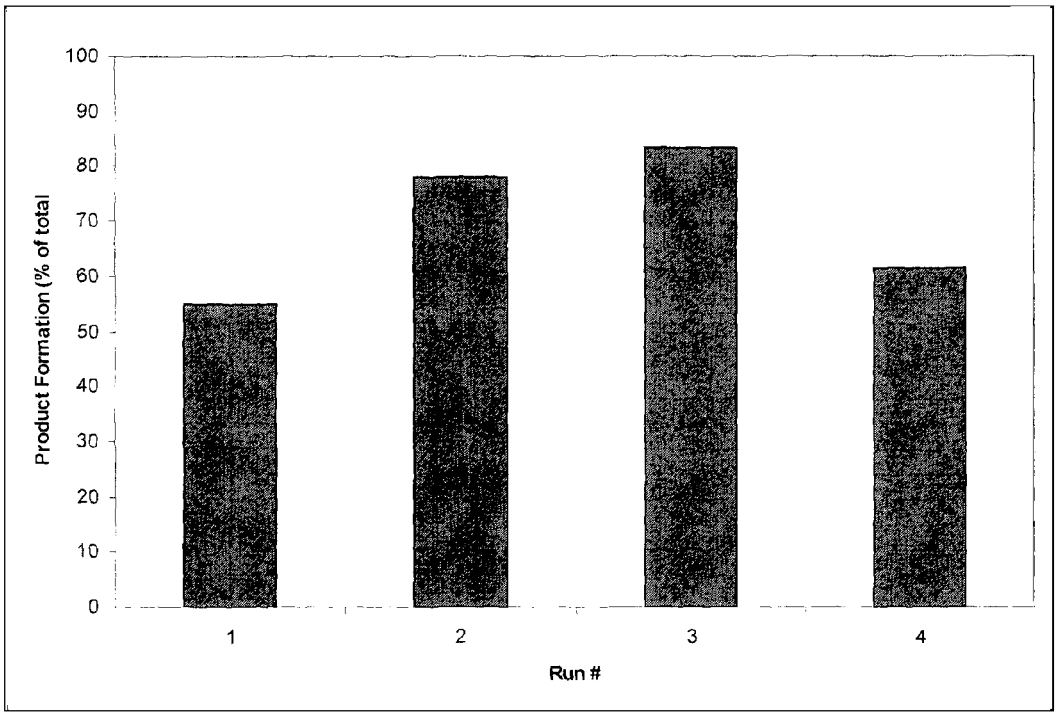
FIG. 14 illustrates the conversion of 4-phenylbutyric acid by Lipase B in the presence of hexylamine over 4 consecutive 24 h incubations in the bioreactor.

Following the design and assembly of the bioreactor, the stability of the enzyme over time in the bioreactor was determined. Literature reports indicated that Lipase B was stable over time across multiple runs in other industrial applications. This experiment was performed to confirm the stability across several runs in the presence of organic acids in an organic system. Further, this would confirm the feasibility of the bioreactor design for use in a bioupgrading process for converting naphthenic acids. The reactor was charged with Lipase at the outset, and a freshly prepared reaction mixture of hexylamine and PBA was used in 4 successive 24 h incubations. GC-MS analysis (FIG. 14) showed product formation was consistent with the performance observed in the previous apparatus, and the enzyme remained stable and productive over 4 consecutive 24 h runs.

The invention claimed is:

1. A process for converting naphthenic acid containing crude oil into non-corrosive products, the process comprising:

a. contacting said naphthenic acid containing crude oil with a long chain alkyl amine in a hydrophobic organic solvent with a boiling point below 100° C., at a temperature between about 40° C. and about 60° C. and at ambient pressure, wherein a ratio of the long chain alkyl amine to naphthenic acid is between 1 to 1.1 and 1 to 1.4; and b. incubating the mixture obtained from step (a) in the presence of lipase enzyme under conditions of suitable temperature and pressure sufficient to form the corresponding amides.

2. The process according to claim 1, wherein the lipase enzyme is an enzyme that biosynthesizes amides.

3. The process according to claim 2, wherein the lipase enzyme is lipase B.

4. The process according to claim 1, wherein the amines are selected from a group consisting of ammonium carbamate, dodecylamine, cyclopentylamine and hexylamine.

5. The process according to claim 4, wherein the hydrophobic organic solvent is selected from the group consisting of toluene, hexane, and heptane.

6. The process according to claim 1, wherein the mixture is incubated for 24 hours.

7. The process according to claim 1, wherein the lipase enzyme is in solution.

8. The process according to claim 1, wherein the lipase enzyme is in insoluble form mobilized onto an inert support.

* * * * *